US010648680B2

(12) United States Patent
Heo et al.

(10) Patent No.: US 10,648,680 B2
(45) Date of Patent: May 12, 2020

(54) HOT WATER SUPPLY SYSTEM HAVING PREHEATING FUNCTION AND METHOD FOR CONTROLLING SAME

(71) Applicant: KYUNGDONG NAVIEN CO., LTD., Pyeongtaek-si (KR)

(72) Inventors: Chang Heoi Heo, Seoul (KR); Yong Min Song, Seoul (KR); Soon Ki Kim, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 2 days.

(21) Appl. No.: 16/068,991

(22) PCT Filed: Dec. 9, 2016

(86) PCT No.: PCT/KR2016/014444
§ 371 (c)(1),
(2) Date: Jul. 10, 2018

(87) PCT Pub. No.: WO2017/131341
PCT Pub. Date: Aug. 3, 2017

(65) Prior Publication Data

US 2019/0078794 A1 Mar. 14, 2019

(30) Foreign Application Priority Data

Jan. 25, 2016 (KR) ..... 10-2016-0008701

(51) Int. Cl.
*F24D 17/00* (2006.01)
*F24D 19/10* (2006.01)

(52) U.S. Cl.
CPC ..... *F24D 17/0078* (2013.01); *F24D 17/0026* (2013.01); *F24D 17/0094* (2013.01);
(Continued)

(58) Field of Classification Search
CPC ..... F24D 17/0078; F24D 17/0094; Y10T 137/6497
See application file for complete search history.

(56) References Cited

U.S. PATENT DOCUMENTS 5,009,572 A * 4/1991 Imhoff ..... F24D 17/00 122/13.3
5,205,318 A * 4/1993 Massaro ..... F24D 17/0078 122/13.3
(Continued)

FOREIGN PATENT DOCUMENTS

JP 2005291623 A 10/2005
KR 1020040067525 A 7/2004
(Continued)

OTHER PUBLICATIONS

International Search Report of PCT/KR2016014444, dated Mar. 20, 2017, English Translation.

*Primary Examiner* — Kevin F Murphy
(74) *Attorney, Agent, or Firm* — STIP Law Group, LLC

(57) ABSTRACT

A hot water supply system according to the present invention includes: a hot water supply unit configured to supply hot water; an opening and closing valve configured to connect a hot water supply pipe, which is configured to supply hot water to a user from the hot water supply unit, and a cold water supply pipe, which is configured to supply cold water introduced from a cold water inflow pipe to the user, to allow water to flow or configured to disconnect the hot water supply pipe from the cold water supply pipe to block the water from flowing; a circulation pump configured to circulate water supplied from the hot water supply unit through the hot water supply pipe, the opening and closing valve, the cold water supply pipe, and the hot water supply unit; and a control unit configured to, when a water-preheating signal of the user is input, open the opening and
(Continued)

closing valve, and operate the circulation pump to preheat water which is to be supplied to the user.

9 Claims, 5 Drawing Sheets

(52) U.S. Cl.
CPC ..... *F24D 19/1024* (2013.01); *F24D 19/1051* (2013.01); *F24D 2220/025* (2013.01); *F24D 2220/0207* (2013.01); *F24D 2220/042* (2013.01); *F24D 2220/044* (2013.01); *Y10T 137/6497* (2015.04)

(56) References Cited

U.S. PATENT DOCUMENTS 5,261,443 A * 11/1993 Walsh ..... F24D 17/0078 122/13.3
6,895,985 B2 * 5/2005 Popper ..... E03B 7/04 137/2
6,962,162 B2 * 11/2005 Acker ..... E03B 7/04 137/1
7,198,059 B2 * 4/2007 Kempf ..... E03B 1/048 137/269
2010/0126604 A1 * 5/2010 Lund ..... F24D 17/0078 137/565.01
2015/0354832 A1 * 12/2015 Sato ..... F24D 17/0078 122/14.3

FOREIGN PATENT DOCUMENTS

KR 1020060110513 A 10/2006
KR 1020100001501 A 1/2010
KR 1020110032135 A 3/2011

* cited by examiner

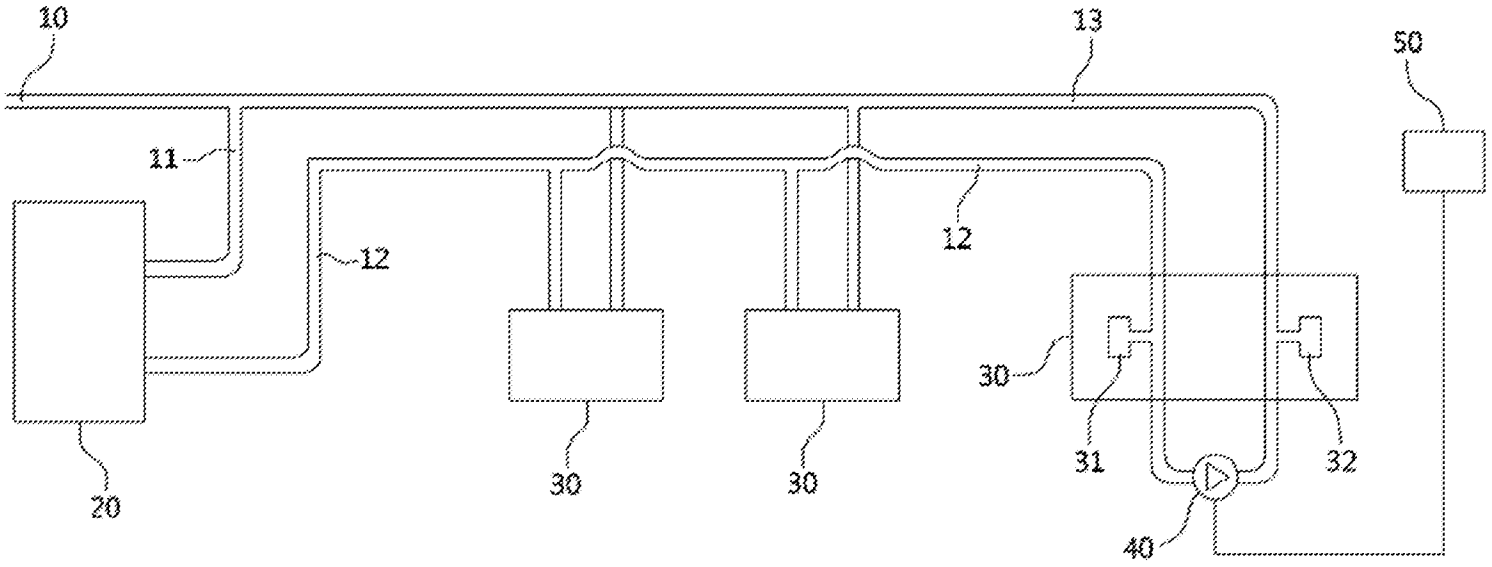
PRIOR ART
[FIG. 1]

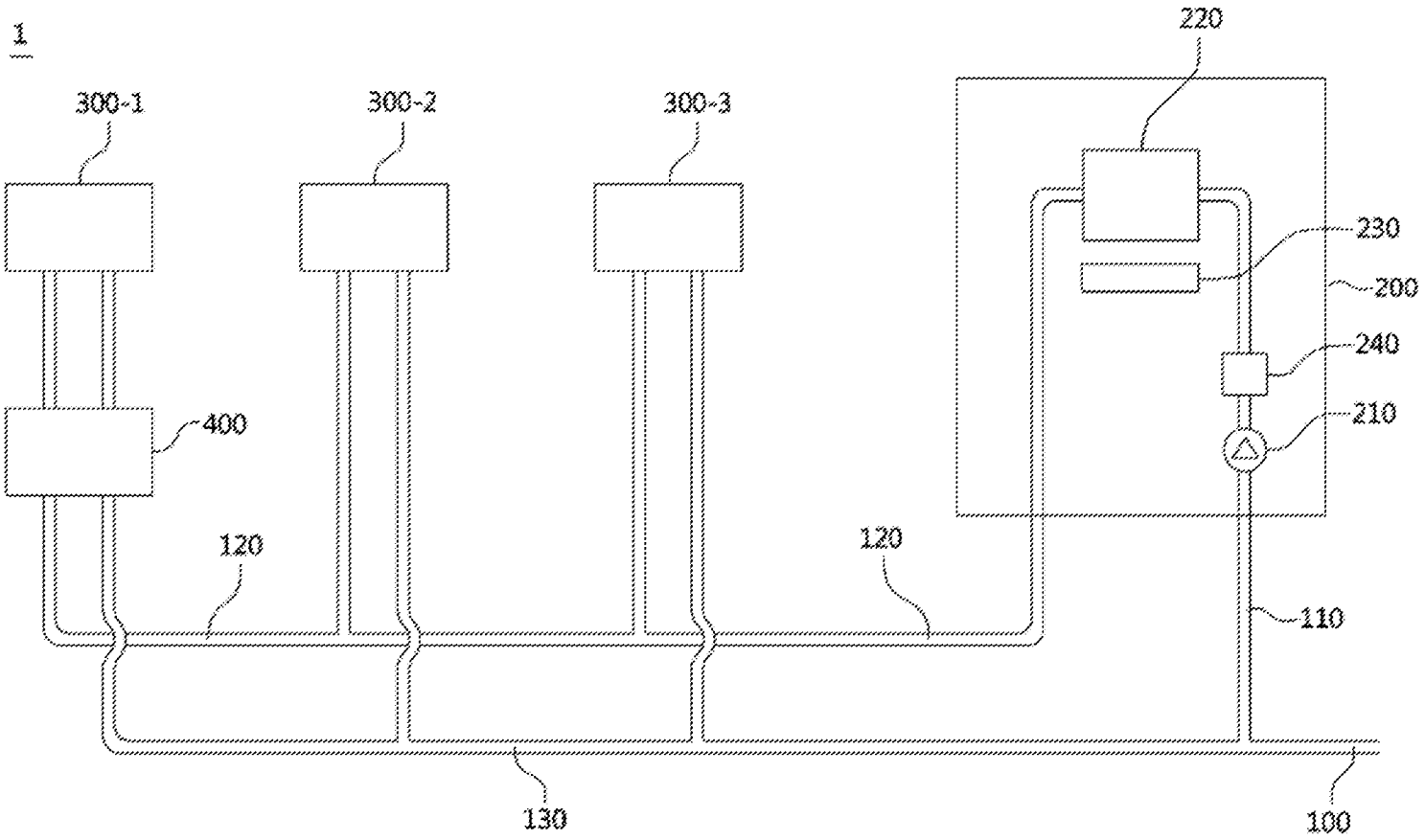
[FIG. 2]

[FIG. 3]
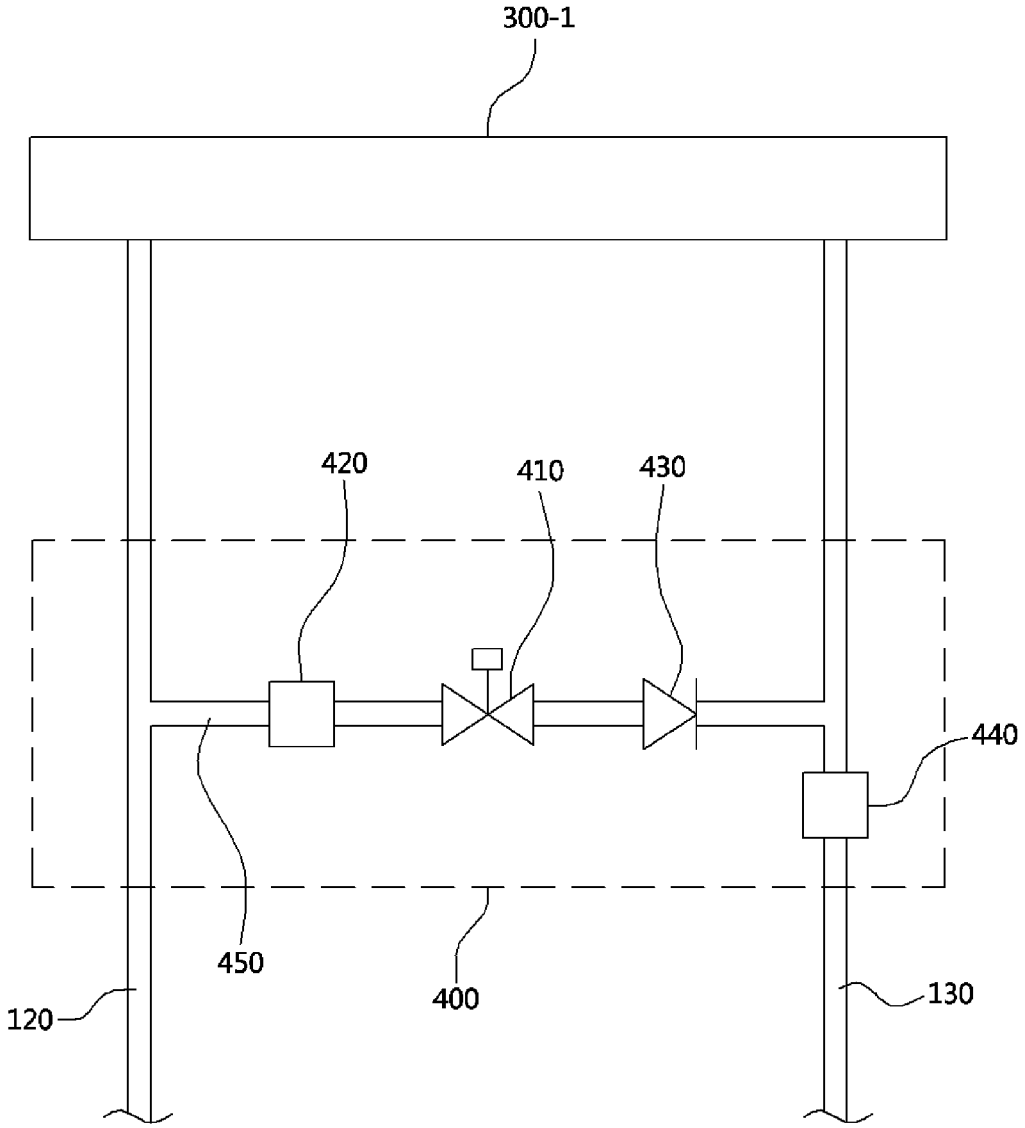

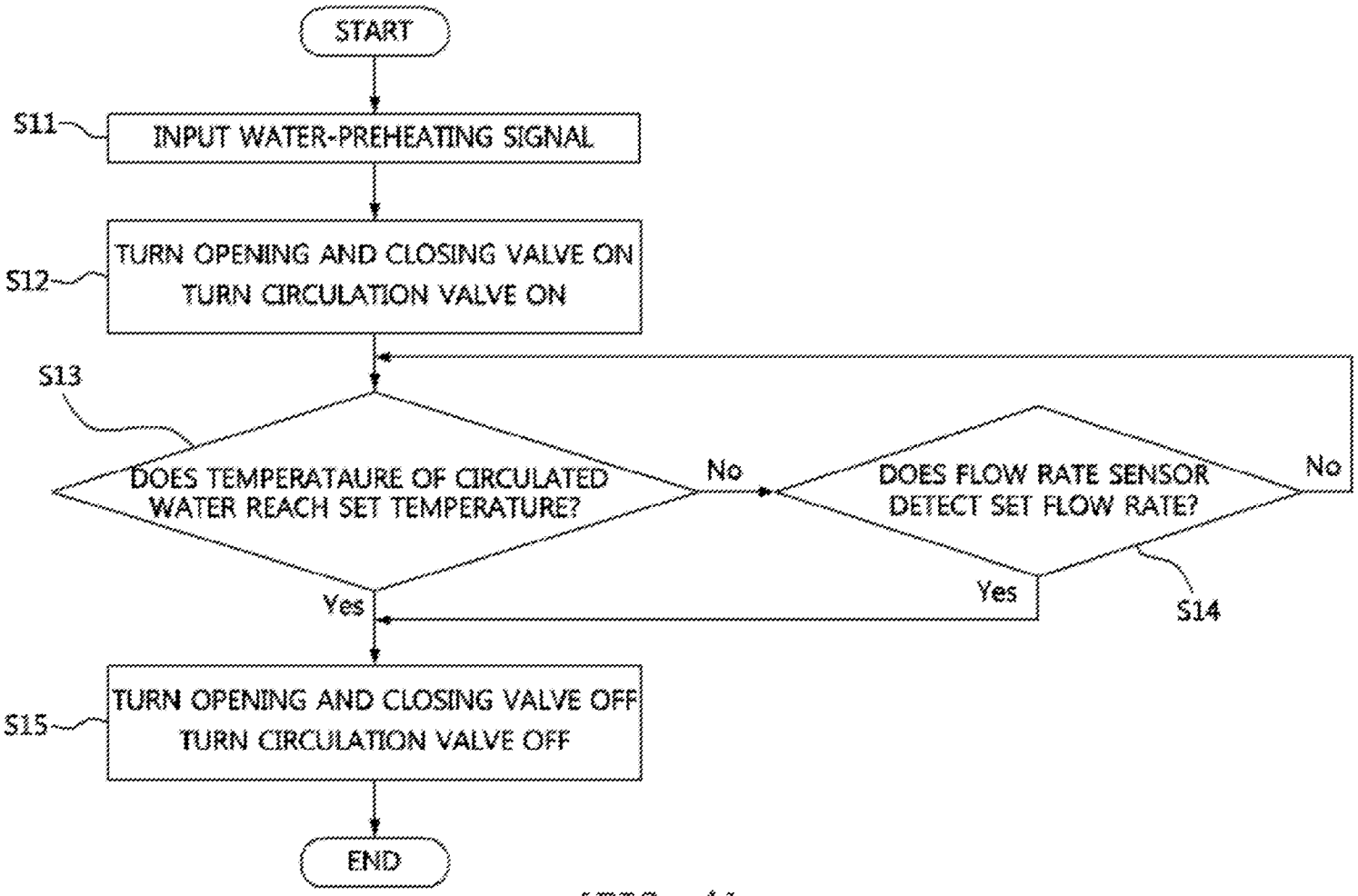
[FIG. 4]

[FIG. 5]
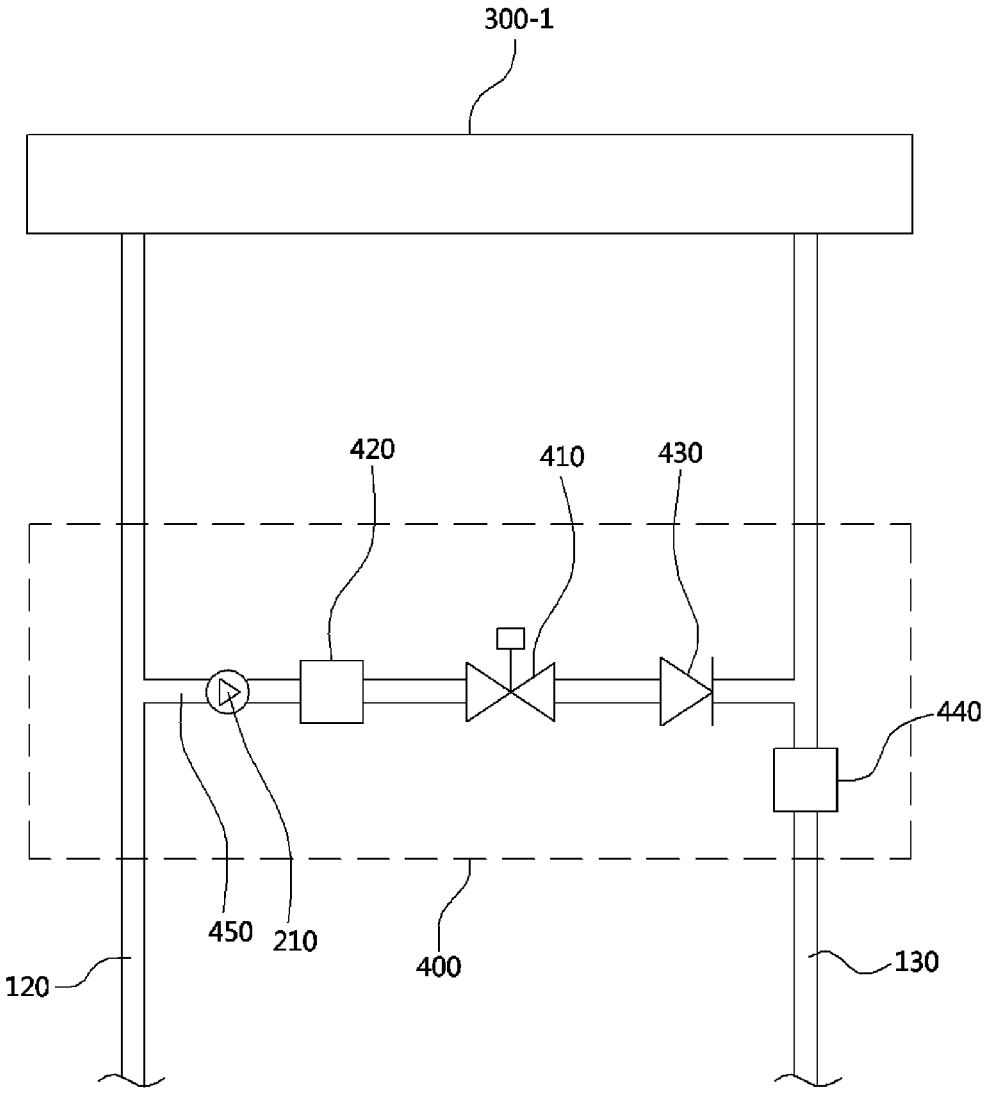

HOT WATER SUPPLY SYSTEM HAVING PREHEATING FUNCTION AND METHOD FOR CONTROLLING SAME

CROSS-REFERENCE TO RELATED APPLICATIONS

This application is the U.S. National Phase under 35 U.S.C. § 371 of International Application No. PCT/KR2016/014444 filed on Dec. 9, 2016, which in turn claims the benefit of Korean Application No. 10-2016-0008701, filed on Jan. 25, 2016, the disclosures of which are incorporated by reference into the present application.

TECHNICAL FIELD

The present invention relates to a hot water supply system having a preheating function and a method of controlling the same, and more particularly, to a hot water supply system capable of heating water to prevent unheated water from being thrown away by a user when hot water is initially used, in a case in which the user uses the hot water, and a method of controlling the same.

BACKGROUND ART

A hot water supply system is a system configured to heat cold water so that the water has a predetermined temperature in a short time and supply the hot water so that a user conveniently uses the hot water.

Such a hot water supply system burns oil or gas as a fuel using a burner, heats water using combustion heat generated during a combustion process, and provides the heated water to a user as necessary.

While the user opens a hot water valve to use hot water, and an operation for hot water is started, and hot water is heated to an optimal temperature, since cold water is discharged and thrown away through a hot water discharging port, waste of water energy occurs, the user has to wait until the hot water having the optimal temperature is supplied, and thus there is a problem in that hot water use is inconvenient.

To solve such a problem, "Method for controlling hot water pre-heating of hot water heater according to hot water using pattern of user" is disclosed in Korean Patent Publication No. 10-2013-0126299.

According to the related art of the method of preheating water, it is determined that water needs to be preheated according to a hot water using pattern of a user, and the water is preheated prior to being used by the user.

However, when the user preheats water prior to using the hot water, energy may be wasted.

FIG. 1 is a view illustrating a conventional hot water supply system which is a system configured to preheat water while circulating the water in a case in which a water-preheating signal of a user is detected.

The hot water supply system of FIG. 1 includes a water-preheating signal generating unit 50 configured to generate a water-preheating signal by detecting a case in which a user desires to preheat water using a sensor or when a user pushes a button, and when the water-preheating signal is input in a control unit, the control unit operates a circulation pump 40 to sequentially circulate water supplied from a hot water supply apparatus 20 through a hot water supply pipe 12, the circulation pump 40, a cold water supply pipe 13, a cold water inflow pipe 11, and a hot water supply apparatus 20 to preheat water. After such a preheating process is performed, when the user opens a hot water valve 31, the hot water having a temperature desired by the user is supplied.

A reference numeral "10," "30," and "32" respectively denote a cold water inflow pipe through which cold water is introduced, a tap, and a cold water valve.

However, according to such a conventional hot water supply system, the circulation pump 40 is provided on a pipe connected to the hot water supply pipe 12 and the cold water supply pipe 13, and hot water and cold water may be mixed through the connected pipe. Accordingly, when a user opens the cold water valve 32 to use cold water while hot water circulates for preheating, there is a problem in that the hot water in the hot water supply pipe 12 is discharged through the circulation pump 40 and the cold water valve 32. Conversely, when the user opens the hot water valve 31 to use hot water in a state in which an operation of the circulation pump 40 is stopped, there is a problem in that cold water of the cold water supply pipe 13 is discharged through the circulation pump 40 and the hot water valve 32.

DISCLOSURE

Technical Problem

The present invention is directed to providing a hot water supply system capable of preheating water to supply hot water, preventing the water in a hot water supply pipe from flowing to a cold water supply pipe or the water in the cold water supply pipe from flowing to the hot water supply pipe to supply the water having a temperature desired by a user in a case in which the hot water supply system supplies the cold water or the hot water to the user, and a method of controlling the hot water supply system.

Technical Solution

One aspect of the present invention provides a hot water supply system having a preheating function including: a hot water supply unit (200) configured to supply hot water; an opening and closing valve (410) configured to connect a hot water supply pipe (120), which is configured to supply hot water to a user from the hot water supply unit (200), and a cold water supply pipe (130), which is configured to supply cold water introduced from a cold water inflow pipe (100) to the user, to allow water to flow or configured to disconnect the hot water supply pipe (120) from the cold water supply pipe (130) to block the water from flowing; a circulation pump (210) configured to circulate water supplied from the hot water supply unit (200) through the hot water supply pipe (120), the opening and closing valve (410), the cold water supply pipe (130), and the hot water supply unit (200); and a control unit configured to, when a water-preheating signal of the user is input, open the opening and closing valve (410), and operate the circulation pump (210) to preheat water which is to be supplied to the user.

The hot water supply system may further include a connecting pipe (450) configured to connect the hot water supply pipe (120) and the cold water supply pipe (130), wherein the opening and closing valve (410) may be provided on the connecting pipe (450).

A check valve (430) configured to allow water to flow only in a direction from the hot water supply pipe (120) to the cold water supply pipe (130), and block the water from flowing in a reverse direction of the direction may be provided on the connecting pipe (450).

The hot water supply system may further include a temperature sensor (420) configured to measure a temperature of water circulated by the circulation pump (210), wherein the opening and closing valve (410) may be opened or closed on the basis of a temperature measured by the temperature sensor (420).

The temperature sensor (420) may be provided on the connecting pipe (450) which connects the hot water supply pipe (120) and the cold water supply pipe (130).

The hot water supply system may further include a second flow rate sensor (440) configured to detect a flow rate of water flowing in the cold water supply pipe (130), wherein opening or closing of the opening and closing valve (410) may be controlled on the basis of the flow rate measured by the second flow rate sensor (440).

The circulation pump (210) may be provided in the hot water supply unit (200).

The opening and closing valve (410) may be provided in a circulation module (400), and the circulation module (400) may be detachably connected to the hot water supply pipe (120) and the cold water supply pipe (130).

Another aspect of the present invention provides a method of controlling a hot water supply system which has a preheating function and in which a hot water supply unit (200) supplies hot water to a user through a hot water supply pipe (120), cold water is supplied to the user through a cold water supply pipe (130), and a control unit controls a circulation pump (210) to circulate hot water supplied from the hot water supply unit (200) through the hot water supply pipe (120), the cold water supply pipe (130), and the hot water supply unit (200), the method comprising: an operation a) in which the user inputs a water-preheating signal in the control unit; an operation b) in which the opening and closing valve (410) is opened to connect the hot water supply pipe (120) and the cold water supply pipe (130) to allow water to flow, and the circulation pump (210) is operated to circulate water supplied from the hot water supply unit (200) through the hot water supply pipe (120), the cold water supply pipe (130), and the hot water supply unit (200) to preheat the water; and an operation C) in which, when the control unit determines that a preheating process is completed, the control unit closes the opening and closing valve (410) and stops the operation of the circulation pump (210) to end the preheating mode.

In the operation b), the temperature sensor (420) may detect a temperature of the water circulated by the circulation pump (210); in the operation c), in a case in which the water temperature detected by the temperature sensor (420) reaches a temperature set in the control unit, the control unit may determine that the preheating process is completed; and when the preheating process is determined as completed, the control unit may stop the operation of the circulation pump (210) and close the opening and closing valve (410).

In the operation b), a second flow rate sensor (440) may detect a flow rate of the water flowing in the cold water supply pipe (130); and when the flow rate detected by the second flow rate sensor (440) reaches a flow rate set in the control unit, it is determined that the user may use cold water, the opening and closing valve (410) may be closed, and the operation of the circulation pump (210) may be stopped.

The hot water supply system may include a cold water inflow pipe (110) through which cold water is introduced into the hot water supply unit (200), and a first flow rate sensor (240) configured to detect a flow rate of cold water introduced through a cold water inflow pipe (110), and during the operation b), when a change in which a flow rate detected by a first flow rate sensor (240) exceeds a range of a flow rate set in the control unit occurs, it is determined that the user may use hot water, and the operation of the circulation pump (210) may be stopped.

Advantageous Effects

According to the present invention, since an opening and closing valve configured to connect or disconnect a cold water supply pipe and a hot water supply pipe is provided, cold water can be prevented from flowing to the hot water supply pipe, or hot water can be prevented from flowing to the cold water supply pipe, and thus water having a temperature desired by a user can be supplied.

In addition, since a check valve is provided between the cold water supply pipe and the hot water supply pipe, cold water is prevented from being mixed with hot water in the hot water supply pipe when discharged, and thus water having a temperature desired by the user can be supplied.

In addition, since flow rate sensors are provided on the cold water supply pipe, and the flow rate sensors control an opening and closing valve on the basis of a detected flow rate, in a case in which cold water supply is required during a preheating mode, cold water can be prevented from being mixed with hot water when discharged.

DESCRIPTION OF DRAWINGS

FIG. 1 is a view illustrating a conventional hot water supply system.

FIG. 2 is a view illustrating a hot water supply system according to the present invention.

FIG. 3 is a view illustrating a detailed configuration of a circulation module illustrated in FIG. 2.

FIG. 4 is flowchart of a method of controlling the hot water supply system according to the present invention.

FIG. 5 is a view illustrating a detailed configuration of circulation module according to another embodiment of the present invention.

REFERENCE NUMERALS

1: HOT WATER SUPPLY SYSTEM
100, 110: COLD WATER INFLOW PIPE
120: HOT WATER SUPPLY PIPE
130: COLD WATER SUPPLY PIPE
200: HOT WATER SUPPLY UNIT
210: CIRCULATION PUMP
220: HEAT EXCHANGER
230: BURNER
240: FIRST FLOW RATE SENSOR
300-1, 300-2, 300-3: TAP
400: CIRCULATION MODULE
410: OPENING AND CLOSING VALVE
420: TEMPERATURE SENSOR
430: CHECK VALVE
440: SECOND FLOW RATE SENSOR
450: CONNECTING PIPE

MODES OF THE INVENTION

Hereinafter, configurations and operations of embodiments of the present invention will be described in detail with reference to the accompanying drawings.

A configuration of a hot water supply system according to the present invention will be described with reference to FIGS. 2 and 3.

A hot water supply system 1 according to the present invention includes a hot water supply unit 200 configured to heat cold water introduced through a cold water inflow pipe 100 to generate hot water, a circulation module 400 configured to circulate the hot water heated by the hot water supply unit 200 through a hot water supply pipe 120 and a cold water supply pipe 130 when a water-preheating signal is input from a user, and a control unit (not shown) configured to perform a control to preheat water and supply hot water.

A circulation pump 210 for circulating water during a preheating mode is provided in the hot water supply unit 200.

A heat exchanger 220 and a burner 230 for generating hot water may be provided in the hot water supply unit 200. In addition, a first flow rate sensor 240 for detecting flow of cold water when the cold water is introduced into the hot water supply unit 200 through cold water inflow pipes 100 and 110 may be provided in the hot water supply unit 200 to supply hot water.

Alternatively, the hot water supply unit 200 may also be formed as a hot water storage tank configured to store hot water, and a separate apparatus configured to heat water and supply the hot water to the hot water storing tank may also be formed. In this case, pipe connection also has to be changed.

Hot water generated by the hot water supply unit 200 and cold water introduced through the cold water inflow pipe 100 are supplied to the user through taps 300-1, 300-2, and 300-3.

The hot water supply unit 200, the taps 300-1, 300-2, and 300-3, and the circulation module 400 are connected by a plurality of pipes. That is, the cold water inflow pipes 100 and 110 through which cold water is introduced, the hot water supply pipe 120 for supplying hot water supplied from the hot water supply unit 200 to the taps 300-1, 300-2, and 300-3, and the cold water supply pipe 130 for suppling cold water introduced through the cold water inflow pipe 100 to the taps 300-1, 300-2, and 300-3 are provided.

The circulation module 400 includes a connecting pipe 450 which connects the hot water supply pipe 120 and the cold water supply pipe 130, an opening and closing valve 410, a temperature sensor 420, and a check valve 430 are provided on the connecting pipe 450, and a second flow rate sensor 440 for detecting flow of water flowing through the cold water supply pipe 130.

Since the circulation module 400 is modularized, the circulation module 400 may be detachably provided with the hot water supply pipe 120 and the cold water supply pipe 130.

The opening and closing valve 410 may be formed as a solenoid valve. When the opening and closing valve 410 is turned on, the valve is opened to allow water to flow through the connecting pipe 450, and when the opening and closing valve 410 is turned off, the valve is closed to block water from flowing through the connecting pipe 450. Accordingly, when opening and closing valve 410 is turned off, water flowing in the cold water supply pipe 130 is blocked from flowing to the hot water supply pipe 120, and conversely, water flowing in the hot water supply pipe 130 is also blocked from flowing to the cold water supply pipe 130.

The opening and closing valve 410 is turned on only during a preheating mode in which water is preheated to circulate the water.

The temperature sensor 420 measures a temperature of water flowing in the connecting pipe 450 during the preheating mode, and when the measured temperature reaches a set temperature set in the control unit, the control unit determines a preheating process is completed, turns the opening and closing valve 410 off, and stops an operation of the circulation pump 210.

The check valve 430 allows water to flow from the hot water supply pipe 120 to the cold water supply pipe 130, but blocks water from flowing in a reverse direction thereof.

During the preheating mode, the opening and closing valve 410 is opened, but in a case in which hot water is discharged through the tap 300-1 according to a hot water supply request of the user, the opening and closing valve 410 is closed. In this case, it takes time to close the opening and closing valve 410 after detecting that the hot water is discharged through the tap 300-1. Before the opening and closing valve 410 is closed, cold water in the cold water supply pipe 130 may flow through the connecting pipe 450, may be mixed with hot water in the hot water supply pipe 120, and may be discharged through the tap 300-1. Accordingly, when there are no check valves 430, since the cold water is mixed with the hot water and discharged, it is difficult to quickly supply hot water having a temperature desired by the user. The present invention provides the check valve 430 on the connecting pipe 450 to solve the above-described problem.

The second flow rate sensor 440 measures a flow rate of water flowing in the cold water supply pipe 130. During the preheating mode, the opening and closing valve 410 is opened. In this state, in a case in which cold water is discharged through the tap 300-1 according to a cold water supply request of the user, since water in the hot water supply pipe 120 may flow through the connecting pipe 450, be mixed with cold water in the cold water supply pipe 130, and be discharged through the tap 300-1, it is difficult to quickly supply cold water having a temperature desired by the user. Accordingly, when the second flow rate sensor 440 detects flow having a set flow rate set in the control unit during the preheating mode, the opening and closing valve 410 is controlled to be closed, and thus the hot water is prevented from being mixed with the cold water when discharged.

A method of controlling the hot water supply system according to the present invention will be described with reference to FIG. 4.

In an operation S11, a user inputs a water-preheating signal to the control unit.

Here, the water-preheating signal is a signal which is generated by the user for preheating water before using hot water and may be generated by pushing a button or detection of a sensor.

In an operation S12, the control unit starts the preheating mode when the water-preheating signal is input. When the preheating mode starts, the control unit operates the burner 230 to heat water in the heat exchanger 220 and simultaneously turns the opening and closing valve 410 and the circulation pump 210 on. The water heated in the hot water supply unit 200 is moved by the circulation pump 210, sequentially flows through the hot water supply pipe 120, the connecting pipe 450, and the cold water supply pipe 130, and returns to the circulation pump 210.

In an operation S13, the temperature sensor 420 measures a temperature of the circulated water, and determines whether the measured temperature of the circulated water reaches a temperature set in the control unit.

When a preheating process is determined as completed, an operation S15 is performed, and otherwise, an operation S14 is performed.

In the operation S15, since the preheating process is completed, the opening and closing valve 410 and the circulation pump 210 are turned off, and the preheating mode ends.

In the operation S13, there is a case in which the user uses hot or cold water before a temperature of the circulated water does not reach the set temperature (that is, before the preheating mode ends). In this case, the preheating mode may end on the basis of a flow rate detected by each of the flow rate sensors 240 and 440.

That is, during the preheating mode, when the user opens a hot water valve (not shown) provided in the tap 300-1 to use hot water, water is introduced into the hot water supply unit 200 through the cold water inflow pipes 100 and 110. Before the user opens the hot water valve of the tap 300-1, a flow rate (hereinafter, referred to as a first flow rate) of circulated water circulating in the hot water supply unit 200 is detected by the first flow rate sensor 240 during the preheating mode. Then, when the user opens the hot water valve of the tap 300-1, cold water is introduced into the hot water supply unit 200 through the cold water inflow pipes 100 and 110, at this time, a flow rate (hereinafter, referred to as a second flow rate) detected by the first flow rate sensor 240 is increased from the first flow rate. When the control unit compares the first flow rate and the second flow rate and determines that a difference greater than a set difference occurs and the second flow rate exceeds a range of a flow rate of the preheating mode, the control unit ends the preheating mode, closes the opening and closing valve 410, and stops an operation of the circulation pump 210 to supply hot water. In this case, since the check valve 430 is provided on the connecting pipe 450, water in the cold water supply pipe 130 is prevented from being introduced into the hot water supply pipe 120 through the connecting pipe 450 until the opening and closing valve 410 is closed.

In this case, the first flow rate, which is a flow rate of the circulated water, may also be a flow rate detected by the second flow rate sensor 440 provided in the circulation module 400.

Meanwhile, during the preheating mode, when the user opens a cold water valve (not shown) provided in the tap 300-1 to use cold water, cold water is introduced though the cold water inflow pipe 100 and the cold water supply pipe 130 and discharged to the user through the cold water valve of the tap 300-1. In this case, a difference between the flow rate detected by the second flow rate sensor 440 provided on the cold water supply pipe 130 and the flow rate detected during the preheating mode occurs. When the control unit determines that the user uses the cold water from the difference, the control unit ends the preheating mode, closes the opening and closing valve 410, and stops the operation of the circulation pump 210 to supply cold water. In this case, when the operation of the circulation pump 210 is stopped, water in the hot water supply pipe 120 is prevented from being introduced into the cold water supply pipe 120 through the connecting pipe 450 even before the opening and closing valve 410 is closed.

In an operation S15, when the preheating mode ends, the user may open the hot water valve of the tap 300-1 to use the preheated hot water.

Configuration of the circulation module according to another embodiment of the present invention will be described with reference to FIG. 5.

Although the circulation pump 210 is provided in the hot water supply unit 200 in the above-described embodiment, a circulation pump 210 is provided in a circulation module 400 in the present embodiment. When the embodiment is provided as described above, as the circulation module 400 in which the circulation pump 210 is added to a hot water supply system which does not have a water preheating function, the hot water supply system may be changed into a hot water supply system having a water preheating function, and a maintenance of the hot water supply system for preheating water is manageable.

Meanwhile, according to the other embodiment, a circulation pump may also be provided on a circulation path which connects a hot water supply pipe 120 and a cold water supply pipe 130.

The present invention is not limited to the embodiments, and it is clear to those skilled in the art that the present invention may be variously changed and modified within a range which does not depart from the technical gist of the present invention.

The invention claimed is:

1. A hot water supply system having a preheating function comprising:

a hot water supply unit (200) configured to supply hot water;

an opening and closing valve (410) configured to connect a hot water supply pipe (120), which is configured to supply hot water to a user from the hot water supply unit (200), and a cold water supply pipe (130), which is configured to supply cold water introduced from a cold water inflow pipe (100) to the user, to allow water to flow or configured to disconnect the hot water supply pipe (120) from the cold water supply pipe (130) to block the water from flowing;

a circulation pump (210) configured to circulate water supplied from the hot water supply unit (200) through the hot water supply pipe (120), the opening and closing valve (410), the cold water supply pipe (130), and the hot water supply unit (200); and a control unit configured to, when a water-preheating signal of the user is input, open the opening and closing valve (410), and operate the circulation pump (210) to preheat water which is to be supplied to the user, wherein the opening and closing valve (410) is provided on a connecting pipe (450) configured to connect the hot water supply pipe (120) and the cold water supply pipe (130), further comprising; a cold water inflow pipe (110) through which cold water is introduced into the hot water supply unit (200), a first flow rate sensor (240) configured to detect a flow rate of cold water introduced through the cold water inflow pipe (110) to the hot water supply unit (200), and a second flow rate sensor (440) for detecting flow of water flowing through the cold water supply pipe (130) connecting between the cold water inflow pipe (110) and the connecting pipe (450), and when the second flow rate sensor (440) detects flow having a set flow rate set in the control unit during a preheating mode, the control unit controls the opening and closing valve (410) to be closed.

2. The hot water supply system of claim 1, wherein a check valve (430) configured to allow water to flow only in a direction from the hot water supply pipe (120) to the cold water supply pipe (130), and block the water from flowing in a reverse direction of the direction is provided on the connecting pipe (450).

3. The hot water supply system of claim 1, further comprising a temperature sensor (420) configured to measure a temperature of water circulated by the circulation pump (210), wherein the opening and closing valve (410) is opened or closed on the basis of a temperature measured by the temperature sensor (420).

4. The hot water supply system of claim 3, wherein the temperature sensor (420) is provided on a connecting pipe (450) which connects the hot water supply pipe (120) and the cold water supply pipe (130).

5. The hot water supply system of claim 1, wherein the circulation pump (210) is provided in the hot water supply unit (200).

6. The hot water supply system of claim 1, wherein:

the opening and closing valve (410) is provided in a circulation module (400); and the circulation module (400) is detachably connected to the hot water supply pipe (120) and the cold water supply pipe (130).

7. A method of controlling a hot water supply system which has a preheating function and in which when a first flow rate sensor (240) provided in a cold water inflow pipe (110) detects set flow rate, a hot water supply unit (200) is operated to generate cold water introduced through the cold water inflow pipe (110) into hot water, and then supplies hot water to a user through a hot water supply pipe (120), cold water is supplied to the user through a cold water supply pipe (130), and a control unit controls a circulation pump (210) to circulate hot water supplied from the hot water supply unit (200) through the hot water supply pipe (120), the cold water supply pipe (130), and the hot water supply unit (200), the method comprising:

an operation a) in which the user inputs a water-preheating signal in the control unit;

an operation b) in which an opening and closing valve (410) provided on a connecting pipe (450) configured to connect the hot water supply pipe (120) and the cold water supply pipe (130) is opened to allow water to flow through the connecting pipe (450), and the circulation pump (210) is operated to circulate water supplied from the hot water supply unit (200) through the hot water supply pipe (120), the cold water supply pipe (130), and the hot water supply unit (200) to preheat the water; and an operation c) in which, when the control unit determines that a preheating process is completed, the control unit closes the opening and closing valve (410) and stops the operation of the circulation pump (210) to end the preheating mode, wherein:

in the operation b), during a preheating mode, a second flow rate sensor (440) detects a flow rate of the water flowing in the cold water supply pipe (130) connecting between the cold water inflow pipe (110) and the connecting pipe (450), and when the flow rate detected by the second flow rate sensor (440) reaches a flow rate set in the control unit, it is determined that the user uses cold water, the opening and closing valve (410) is closed, and the operation of the circulation pump (210) is stopped.

8. The method of claim 7, wherein:

in the operation b), a temperature sensor (420) detects a temperature of the water circulated by the circulation pump (210);

in the operation c), in a case in which the water temperature detected by the temperature sensor (420) reaches a temperature set in the control unit, the control unit determines that the preheating process is completed; and when the preheating process is determined as completed, the control unit stops the operation of the circulation pump (210) and closes the opening and closing valve (410).

9. The method of claim 7, wherein:

during the operation b), when a change in which a flow rate detected by the first flow rate sensor (240) exceeds a range of a flow rate set in the control unit occurs, it is determined that the user uses hot water, and the operation of the circulation pump (210) is stopped.

* * * * *